US005868805A

United States Patent [19]

Nilsson

[11] Patent Number: 5,868,805

[45] Date of Patent: Feb. 9, 1999

[54] PROCESS FOR INTEGRATED EVAPORATION AND GASIFICATION OF SPENT LIQUOR FROM CELLULOSE COOKING

[75] Inventor: Bengt Nilsson, Skoghall, Sweden

[73] Assignee: Kvaerner Pulping AB, Karlstad, Sweden

[21] Appl. No.: 648,063

[22] PCT Filed: Nov. 8, 1994

[86] PCT No.: PCT/SE94/01046

§ 371 Date: May 17, 1996

§ 102(e) Date: May 17, 1996

[87] PCT Pub. No.: WO95/14811

PCT Pub. Date: Jun. 1, 1995

[30] Foreign Application Priority Data

Nov. 26, 1993 [SE] Sweden ..... 9303923

[51] Int. Cl.[6] ..... C01B 3/22; B01D 1/26; B01D 53/00

[52] U.S. Cl. ..... 48/198.3; 48/197 R; 48/DIG. 3; 159/17.3

[58] Field of Search ..... 48/197 R, 198.3, 48/DIG. 3; 159/17.3

[56] References Cited

U.S. PATENT DOCUMENTS 3,439,724 4/1969 Mason ..... 159/4.09

FOREIGN PATENT DOCUMENTS 318469 12/1969 Sweden .
8607396 12/1986 WIPO .
9312288 6/1993 WIPO .

*Primary Examiner*—Tae Yoon
*Attorney, Agent, or Firm*—W. Warren Taltavull; Farkas & Manelli PLLC

[57] ABSTRACT

The invention relates to a process for integrated evaporation and gasification of spent liquor from the production of cellulose, the gasification taking place in a reactor (1) at a pressure of from atmospheric pressure up to about 150 bar and at a temperature of about 500°–1600° C., by partial combustion of the spent liquor, a gas phase and a phase of solid and/or smelted material being formed in the reactor and being removed therefrom. The invention is characterized in that the combustion gas obtained from the reactor (1) by partial combustion of the spent liquor is brought together in direct contact with spent liquor, which may have been pre-evaporated, in a first stage—for example a venturi scrubber—, with alkali metal compounds, etc., which have been gasified in the combustion gas, being returned to the reactor together with the concentrated spent liquor, after which the combustion gas, preferably in at least one additional stage, is permitted, directly or indirectly, to give off additional evaporation heat to the spent liquor.

10 Claims, 2 Drawing Sheets

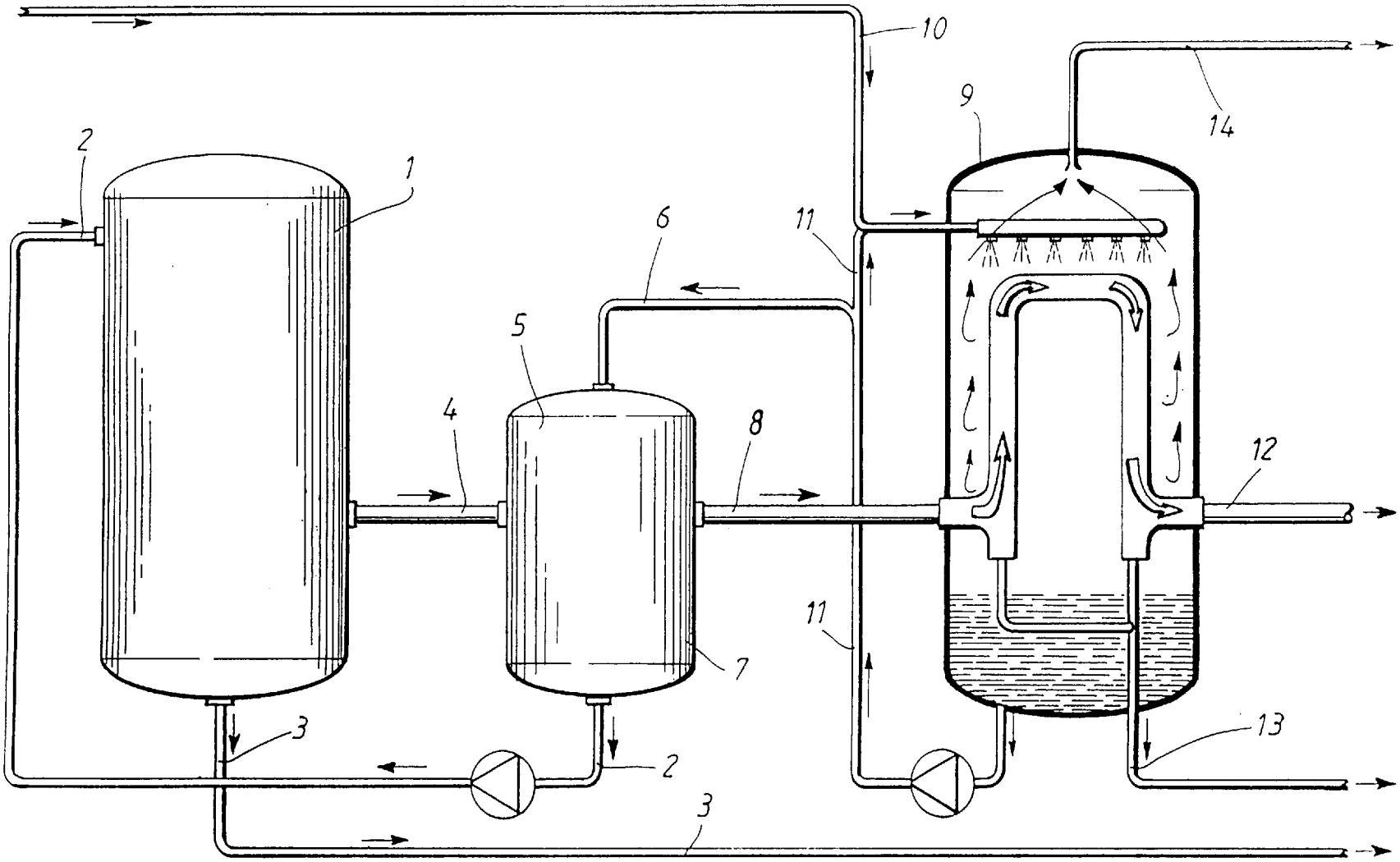
14
12
13
9
10
11
11
8
7
6
3
2
5
4
1
3
2

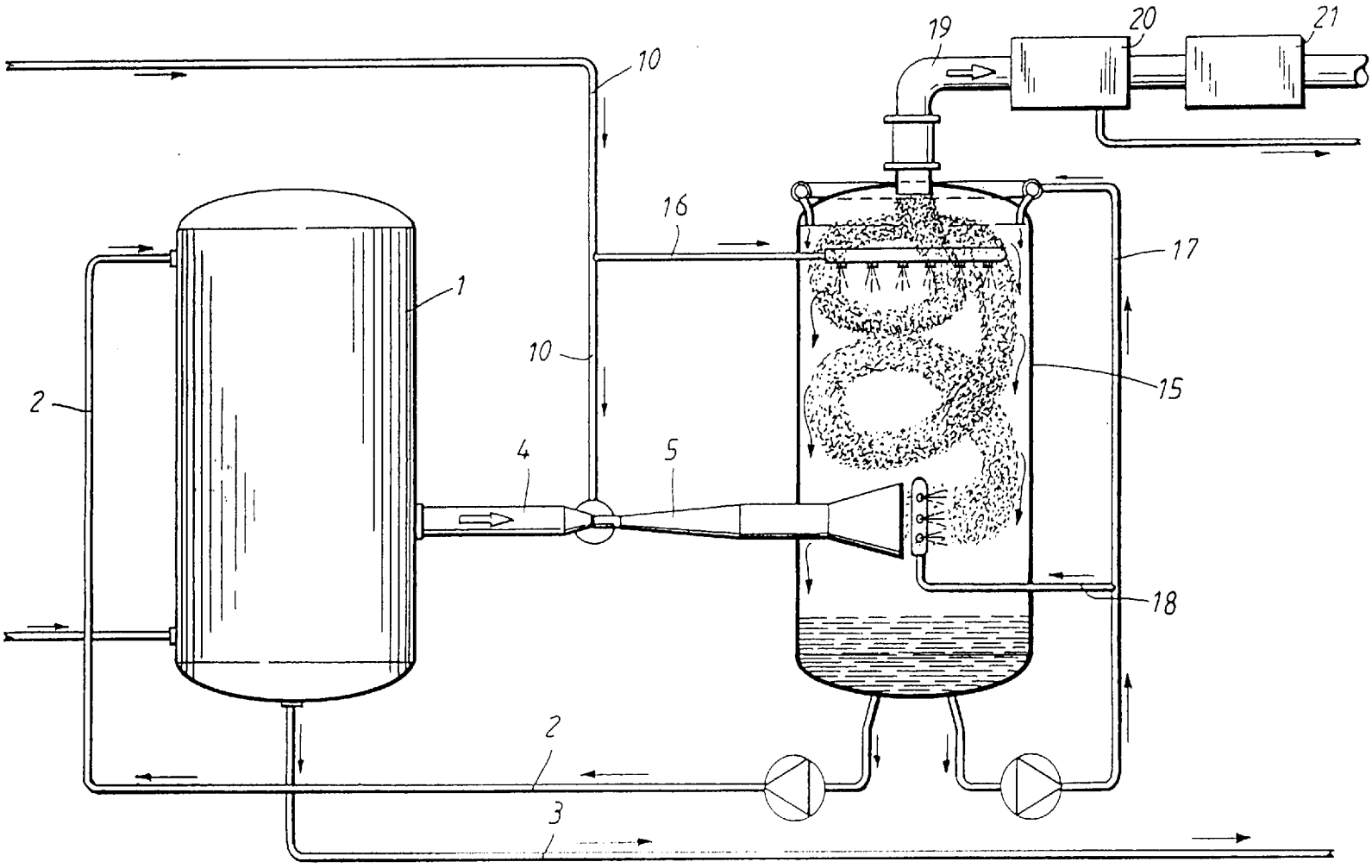
21
20
19
17
15
18
16
10
10
5
4
1
2
2
3

PROCESS FOR INTEGRATED EVAPORATION AND GASIFICATION OF SPENT LIQUOR FROM CELLULOSE COOKING

This application claims benefit of international application PCT/SE94/01,046, filed Nov. 8, 1994.

TECHNICAL FIELD

The present invention relates to a process for integrated evaporation and gasification of spent liquor from the production of cellulose., the evaporation and gasification being integrated in the same system while utilizing the thermal energy in the combustion gases after the gasification.

STATE OF THE ART

A number of systems are already known for evaporating and gasifying spent liquors from cellulose cooking. The spent liquor or the black liquor, as it is usually termed, contains both organic substances and inorganic chemicals, principally alkali, in aqueous solution. The chemical energy which is present in the black liquor is utilized by the organic material being burnt at the same time as the inorganic chemicals are extracted so that they can be re-used in the process. For it to be possible to burn the organic material partially and to recover the chemicals, the major part of the water in the black liquor must be evaporated in advance so that a concentrated spent liquor can be supplied either to a recovery boiler or a gasification reactor.

Evaporation of black liquor is normally effected in several stages, for example in five evaporators coupled in series. For example, evaporation is carried out using three evaporation apparatus coupled in series and the intermediate liquor produced in these apparatus is then supplied to a pair of evaporation apparatus coupled in series for final evaporation, with thick liquor being obtained from these latter apparatus. Heat for the evaporation is supplied by means of admission steam, which expediently has a temperature of 140° C. and which leaves the system at a temperature of 60° C., for example. To make this possible, use is made of vacuum pumps.

Other systems for concentrating black liquor involve pressurizing the liquor after preliminary evaporation, with the liquor then being allowed to expand in an expansion vessel, whereupon steam vaporizes. Such a system is described, for example, in the U.S. Pat. No. 4,909,899.

A further system, which utilizes venturi scrubbers and separators, is described in the Swedish patent 318 469. In this system, use is made of vacuum fans, and exhaust gases are employed at a low temperature which is initially approximately 280° C. and which falls to 74° C. at the outlet for the exhaust gases.

TECHNICAL PROBLEM

The problem with the known solutions is that use must either be made of a supply of admission steam or else the process must be carried out using large installations at relatively low temperature.

There is often a shortage of capacity, both for the spent-liquor evaporation and the recovery stage, the latter being either in the form of a recovery boiler or a gasifier. If a gasifier is used, there is thus usually the need for an equivalent capacity-increasing effect, as regards spent-liquor evaporation, to be achieved in a manner which is cost-effective, energy-saving and environmentally acceptable. There is also the need for the spent liquor to be subjected to an additional concentration-increasing stage prior to the gasifier, at the same time as gasified alkali metal compounds are separated out of the combustion gases as rapidly as possible and returned to the reactor.

SOLUTION

In accordance with the present invention, a process has therefore been developed for evaporating and gasifying spent liquor from the production of cellulose, which process integrates these two process steps, the gasification taking place in a reactor at a pressure of from atmospheric pressure up to about 150 bar and at a temperature of about 500°–1600° C., by means of partial combustion of the spent liquor, a gas phase and a phase of solid and/or smelted material being formed in the reactor and being removed from this reactor, which process is characterized in that the combustion gases from the reactor are brought together, in direct contact, with the spent liquor in a first stage in a venturi scrubber, static mixer or the like, after which the combustion gases are permitted, preferably in at least one additional stage, directly or indirectly to give off additional evaporation heat to the spent liquor.

In accordance with the invention, it is expedient for the additional stage to comprise a film evaporator having indirect heat transfer.

In accordance with the invention, the temperature of the combustion gases is permitted to fall from, preferably, reactor temperature, for example 950° C., down to less than 300° C., preferably less than 250° C. and more preferably to approximately 200° C.

In accordance with the invention, it is expedient for, for example, pre-evaporated spent liquor to be supplied to the second stage in the film evaporator and for a part of the evaporated liquor in the film evaporator to be recirculated and a part to be supplied to the first stage, from which concentrated spent liquor is supplied to the reactor.

In accordance with the invention, the additional stage can, instead, comprise a cyclone evaporator having direct heat transfer between the combustion gases and the liquor.

In accordance with the invention, incoming liquor is supplied partly to the first stage and partly to the second stage in one or more banks of nozzles, and concentrated liquor is both recirculated and in part supplied to the reactor.

In accordance with the invention, at least a part of the $H_2S$ content of the combustion gases can be recirculated to the reactor (the whole quantity or part of the quantity).

In accordance with the invention, the pressure in the reactor should exceed 3 bar, preferably 8 bar and more preferably 20 bar.

DESCRIPTION OF THE FIGURES

The invention will be described in more detail below while referring to the attached drawings, in which FIG. 1 diagrammatically shows an embodiment of the invention, and in which FIG. 2 diagrammatically shows a preferred embodiment of the invention.

PREFERRED EMBODIMENTS

FIG. 1 shows a reactor 1 for gasifying thick liquor by means of the partial combustion of the organic substances. The design of the reactor indicates a quenching device, with the hot gas and smelt phases which are leaving the reactor being cooled in a connecting liquid bath which is arranged beneath the reactor space itself. The pressure in the reactor is, for example, 25 bar and the temperature of the gases 4 leaving the quench is then of the order of size of 200° C. Gasification reactors of this type are well known and will not therefore be described in more detail here. At its upper part, the reactor is fed with thick liquor, which is supplied via a pipe 2. Recovered chemicals are removed from the bottom part via a pipe 3. The reactor can be of a different type and comprise so-called hot-gas separation, signifying that the combustion gases which are fed into the subsequent stage 5 have a temperature of, for example, 950° C. In order to accomplish hot-gas separation, use is preferably made of a liquid film cyclone (see WO 93/01890 or, for example, the method described in WO 93/02249).

In accordance with the invention, the hot, pressurized combustion gases flow, via the pipe 4, into a venturi scrubber or a static mixer, or a combination of these elements. In this latter unit 5, the combustion gases meet black liquor from the pipe 6, which black liquor has already passed through one or more evaporation stages. In this unit, the combustion gas is permitted to have direct contact with the black liquor and evaporates the latter to a desired level which makes it suitable for being introduced into the reactor. The evaporated liquor is removed through the bottom part and is permitted to flow into the pipe 2 via a buffer 7.

The combustion gas flowing from the unit 5 through the pipe 8 is then permitted to flow into a further evaporator 9, which, in the present case, is a falling-film evaporator. In this falling-film evaporator, the combustion gases, which are pressurized, do not come into direct contact with the liquor. The liquor, for example in the form of an intermediate liquor having a dry matter content of 40% and a temperature of approximately 70° C., is supplied to the falling-film evaporator from the top through the pipe 10. This liquor is combined with a more concentrated liquor, from the pipe 11, which is recirculating in the falling-film evaporator. As can be seen in the figure, the pipe 11 branches into a branch 6 which has already been mentioned.

The combustion gas which leaves this second stage in the evaporation process, and which is still pressurized, is conducted out, at a lower temperature, through the pipe 12 for further use. Liquor vapours which have condensed out from the combustion gas are conducted out through the pipe 13.

In the upper part of the falling-film evaporator, pressurized liquor vapour is conducted out through the pipe 14 at a temperature which corresponds to the pressurization, for example 3 bar and above. In accordance with the invention, the liquor vapour can be used, for example, for pre-evaporating incoming black liquor. This liquor vapour thus replaces admission steam, which is normally added at the final evaporation. The pre-evaporation refers to evaporation of mixed liquor having a dry matter content of the order of size of 20%, and brings this liquor up to a so-called intermediate liquor having a dry matter content in the range of 40%, which liquor is fed in through the pipe 10.

The thick liquor which is supplied to the reactor through the pipe 2, and whose evaporation has been finished, has a dry matter content of, for example, 80%.

As has been mentioned above, the combustion gases come into direct contact, in the venturi scrubber or the static mixer, with the black liquor which has been concentrated in previous stages. This avoids the use of heat-transfer surfaces which are difficult to handle and which can easily become encrusted. Alkali and alkali metal compounds which are present in gasified form or in solid form as "submicrons" are also absorbed from the combustion gases in this stage and returned to the gasification reactor by means of the thick liquor.

FIG. 2 shows a preferred embodiment of the present invention. In this embodiment, concentrated black liquor is not removed from the venturi scrubber 5 but is transferred, together with the combustion gases, into a cyclone evaporator 15. In addition to combustion gases, the venturi scrubber 5 is also supplied with intermediate liquor, having a dry matter content of approximately 40% and a temperature of approximately 70° C., through the pipe 10, which pipe 10 also has a bifurcation 16 which opens out in nozzles for spraying intermediate liquor into the upper part of the cyclone evaporator 15. Black liquor, which is recirculating through the conduit 17, is also sprayed into the upper part of the cyclone evaporator 15. In accordance with the invention, this conduit 17 also has a bifurcation 18 which sprays liquor into the hot combustion gases from the venturi scrubber 5. A film of black liquor runs downwards continuously along the walls of the cyclone evaporator and collects at the bottom of the container. After that, the concentrated liquor is removed through the pipe 2 and supplied to the reactor 1.

The combustion gases departing from the top of the cyclone evaporator expediently maintain a temperature of 200° C. and are conducted out via the pipe 19. This pipe 19 has to pass through a heat exchanger 20, which condenses out the moisture content of the combustion gases. The departing, pressurized combustion gas is now treated, inter alia, with regard to the presence of alkali metal compounds.

The pressurized combustion gas can also be treated in a so-called 'acid gas removal' system (AGR) 21. In this system 21, $H_2S$ is extracted and then concentrated and recirculated to the gasification reactor. The reaction equilibrium in the reactor is thereby displaced so that the formation of carbonate compounds in the inorganic smelt phase is suppressed to the greatest possible extent (Pat. No. WO 93/12288).

By means of the present invention, exemplified for black-liquor gasification, treatment of incoming spent liquor is integrated with gasification by means of utilizing the thermal energy of the combustion gas while simultaneously returning alkali metal compounds, etc., which are gasified in the combustion gas, to the gasifier together with concentrated black liquor.

Only two embodiments are shown, but further embodiments are conceivable and the invention is not therefore limited to these two embodiments but can be varied in different ways within the scope of the patent claims. For example, use can be made of other spent liquors, such as spent bleaching liquors, biosludge, etc., within differing concentration ranges. In addition, it will be evident to the person skilled in the art that the second evaporation stage, in accordance with the examples shown, constitutes only one preferred embodiment and that the heat energy remaining in the hot gases after the first stage can be utilized in another manner, for example for producing admission steam. A lower pressure is preferably used in the first stage in conjunction with quench than in conjunction with hot-gas separation, since the available temperature drop is lower for the quench alternative.

Naturally, additional evaporation stages can be coupled together.

I claim:

1. A process for the integrated evaporation and gasification of spent liquor from the production of cellulose using a reactor in which the pressure is maintained in a range of above 3 bar to about 150 bar and a temperature of up to 1600° C. by partial combustion of the spent liquor which forms a combustion gas phase and a phase of solid or smelted material, removing the material from the reactor and separating the gas phase from any remaining phase, then, in a first stage, directly contacting the combustion gas phase with the spent liquor in a mixing means and then using the heat content of the combustion gas phase in at least one additional phase, said additional phase constituting an additional evaporation phase and comprising a film evaporator having indirect heat transfer.

2. The process as claimed in claim 1 wherein the spent liquor is pre-evaporated and is supplied to the additional stage which includes a film evaporator, a part of the evaporated liquor in the film evaporator is recirculated and a part is supplied to the first stage and including the step of supplying concentrated spent liquor from the first stage to the reactor.

3. The process as claimed in claim 1 wherein the combustion gas contains $H_2S$ and including the step of returning the $H_2S$ to the reactor.

4. The process as claimed in claim 1 wherein the separation of the gas phase is a hot-gas separation where the temperature in the combustion gas is permitted to fall to less than 300° C. in the additional stage.

5. The process as claimed in claim 4 wherein the temperature in the combustion gas is permitted to fall to less than 250° C.

6. The process as claimed in claim 4 wherein the temperature in the combustion gas is permitted to fall to less than approximately 200° C.

7. The process as claimed in claim 1 including the step of using a venturi scrubber as the mixing means.

8. The process as claimed in claim 1 including the step of using a static mixer as the mixing means.

9. A process for the integrated evaporation and gasification of spent liquor from the production of cellulose using a reactor in which the pressure is maintained in a range of above 3 bar to about 150 bar and a temperature of up to 1600° C. by partial combustion of the spent liquor which forms a combustion gas phase and a phase of solid or smelted material, removing the material from the reactor and separating the gas phase from any remaining phase, then, in a first stage, directly contacting the combustion gas phase with the spent liquor in a mixing means and then using the heat content of the combustion gas phase in at least one additional phase, said additional phase comprising a cyclone separator having direct heat transfer between the combustion gas and the liquor.

10. Process according to claim 9, characterized in that spent liquor is supplied partly to the first stage and partly to the additional stage in one or more banks of nozzles, and in that concentrated liquor is partly recirculated and partly supplied to the reactor.

* * * * *